US006210217B1

(12) United States Patent
Ping

(10) Patent No.: US 6,210,217 B1
(45) Date of Patent: Apr. 3, 2001

(54) ELECTRICAL CONNECTOR SYSTEM HAVING A CONNECTOR MOUNTED ON A CONDUCTIVE PANEL

(75) Inventor: Ching Yun Ping, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/459,954

(22) Filed: Dec. 13, 1999

(30) Foreign Application Priority Data

Nov. 2, 1998 (TW) ..... 88218636

(51) Int. Cl.[7] ..... H01R 13/74
(52) U.S. Cl. ..... 439/557
(58) Field of Search ..... 439/557, 552; 200/295, 296

(56) References Cited

U.S. PATENT DOCUMENTS 3,052,865 * 9/1962 Pappano et al. ..... 439/552 X
3,168,612 * 2/1965 Sorenson ..... 439/557 X
3,339,050 * 8/1967 Mitchell ..... 200/295
4,947,010 * 8/1990 Heydner et al. ..... 200/296
5,613,876 * 3/1997 Sakatani et al. ..... 439/552

* cited by examiner

*Primary Examiner*—Renee Luebke
(74) *Attorney, Agent, or Firm*—Wei Te Chung

(57) ABSTRACT

An electrical connector system includes an electrical connector and a conductive panel for mounting the electrical connector thereon. The electrical connector includes an insulative housing and a shell enclosing the insulative housing. The shell has a top surface, a bottom surface and a pair of side surfaces. A top flange, a bottom flange and a pair of side flanges respectively outwardly extend from forward edges of the top surface, the bottom surface and the pair of side surfaces. A latching rib upwardly and forwardly extends from a rear edge of the top surface of the shell, and a distal end thereof bends downwardly and forwardly. A retaining flange depends from the bottom surface of the shell adjacent to the bottom flange of the shell. The conductive panel defines a mating slot for accommodating the shell therein. A top projection extends inwardly from a top edge of the mating slot and is retained in a space between the top flange and the latching rib of the shell, and a bottom projection extends inwardly from a bottom edge of the mating slot and is retained between the bottom flange and the retaining flange.

13 Claims, 7 Drawing Sheets

ELECTRICAL CONNECTOR SYSTEM HAVING A CONNECTOR MOUNTED ON A CONDUCTIVE PANEL

BACKGROUND OF THE INVENTION

The present invention relates to an electrical connector system which comprises an electrical connector with a fastening attachment and a panel with a complementary hole, more particularly to an electrical connector system for conveniently and accurately engaging with another electrical connector.

Auxiliary fastening devices such as screws are normally used to mount an electrical connector to a panel, but these make the assembly or disassembly process troublesome. An electrical connector which has a fastening attachment is desired to meet the requirements of mass production. Such an electrical connector is shown in FIG. 6. The electrical connector 50 comprises an elongated insulative housing 501 and a fastening portion 502 projecting rearwardly from the insulative housing 501. A pair of fixing wings 503 respectively depends from opposite top and bottom edges of the fastening portion 502. A retaining portion 504 outwardly extends from a distal end of each fixing wing 503, forming a pair of spaces 505 within the acute angles defined by the fixing wings 503 and the retaining portions 504. A projection 507 extends outwardly from an inward edge of each slit 506. In assembly, an upper edge 512 and a lower edge 513 of a slot 511 in a conductive panel 51 are respectively secured in the angle spaces 505 between the fixing wings 503 and the retaining portions 504.

The fixing wings 503 and the projections 507 are complex and difficult to manufacture, so the design of the electrical connector is not appropriate for inexpensive mass production. Furthermore, the electrical connector can not be conveniently assembled or dissembled, and the projections 507 are easily abraded over time, so that a reliable attachment with the panel cannot be attained. Additionally, the projections 507 are vulnerable to being damaged by strong insertion forces.

BRIEF SUMMARY OF THE INVENTION

A main object of the present invention is to provide an electrical connector system which has an electrical connector with a fastening attachment and a conductive panel with a complementary hole which can be easily assembled together and can endure a strong inserting force.

Another object of the present invention is to provide an electrical connector system which has an insulative housing and a shell for fastening the electrical connector onto a panel and facilitating a convenient assembly and disassembly.

An electrical connector system according to the present invention comprises an insulative housing, a shell enclosing the insulative housing, and a conductive panel defining a mating slot therein. The shell includes a top surface, a bottom surface and a pair of side surfaces together defining a plug receiving opening for receiving the forward receiving slots of the insulative housing therein. A top flange, a bottom flange and a pair of side flanges respectively extend from forward edges of the top surface, the bottom surface and the pair of side surfaces. A latching rib substantially upwardly and forwardly extends and bends from a rear edge of the top surface of the shell, forming an acute angle relative to the top surface of the shell. A distal end of the latching rib bends downwardly and forwardly to form a front end of the latching rib. A retaining flange downwardly depends from the bottom surface of the shell adjacent to the bottom flange of the shell. The conductive panel defines a mating slot for mounting the electrical connector thereon. A top projection extends inwardly from a top edge of the mating slot of the conductive panel and is retained in a space between the top flange and the latching rib of the shell. A bottom projection depends from a bottom edge of the mating slot of the conductive panel and is retained between the retaining flange and the bottom flange of the shell. A first retaining tongue and a second retaining tongue respectively depend from opposite side edges of the mating slot of the conductive panel and firmly contact opposite side surfaces of the shell of the electrical connector for orienting the shell of the electrical connector.

Other objects, advantages and novel features of the invention will become more apparent from the following detailed description when taken in conjunction with the accompanying drawings.

DETAILED DESCRIPTION OF THE INVENTION

Figure 1:
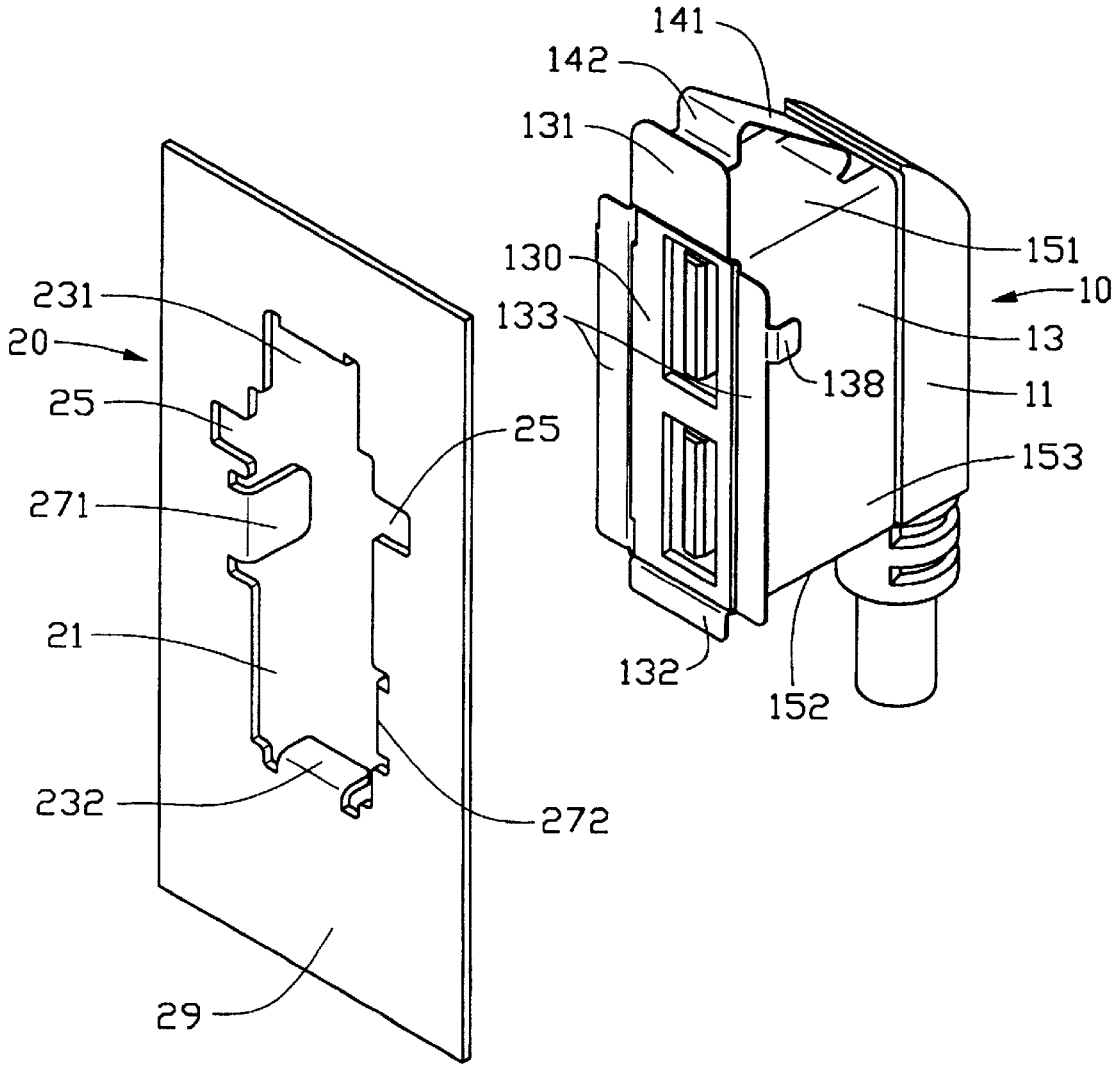
FIG. 1 is a perspective view of an unassembled electrical connector system according to the present invention.
Figure 2:
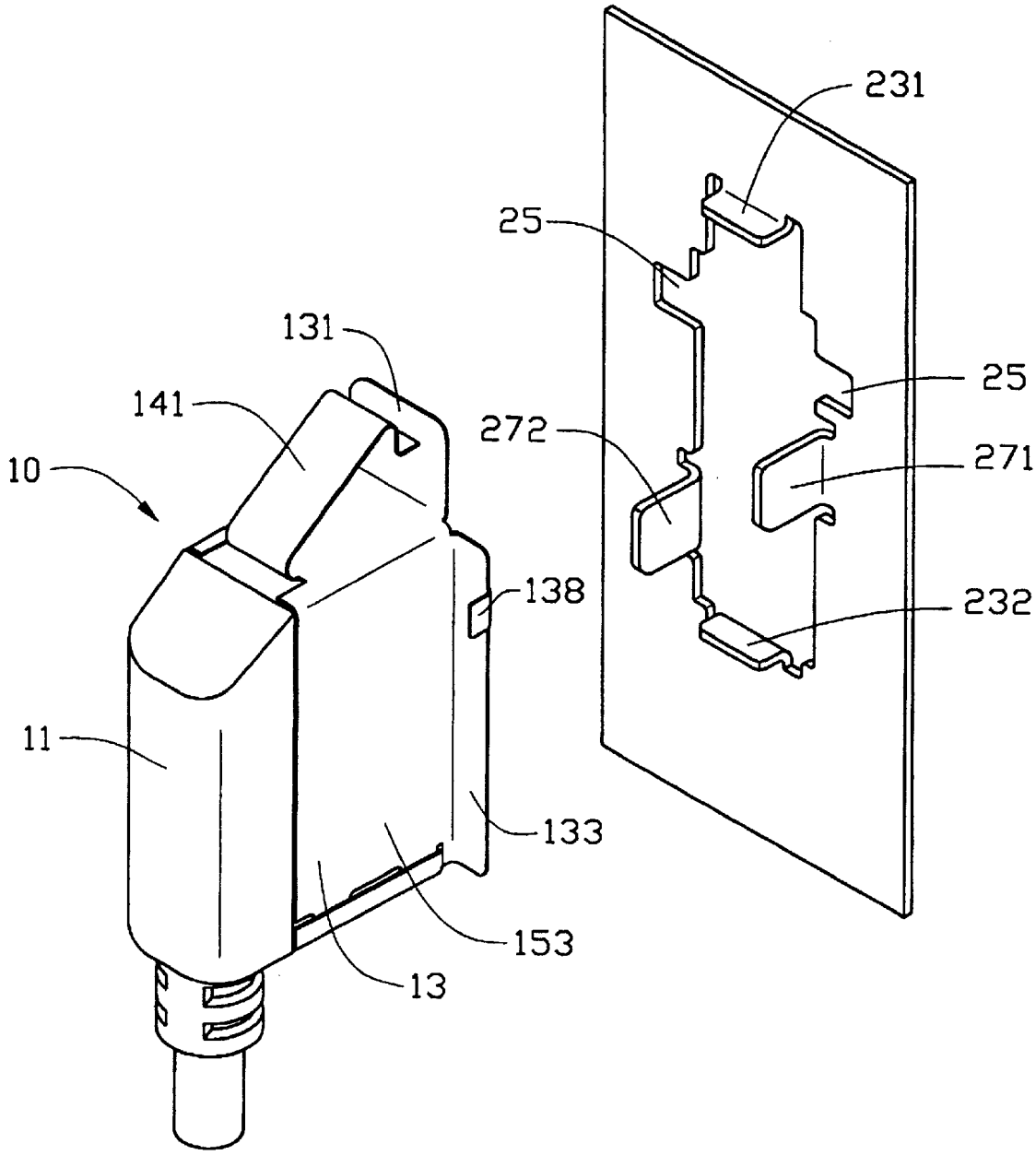
FIG. 2 is the electrical connector system of FIG. 1 viewed from a different aspect.

Referring to FIGS. 1 and 2, an electrical connector system according to the present invention comprises a rectangular insulative housing 11 defining a pair of forward receiving slots (not labeled) therein for receiving a mating electrical connector (not shown), a shell 13 enclosing the insulative housing 11, and a conductive panel 20. The shell 13 is unitarily formed by stamping a metal sheet and includes a top surface 151, a bottom surface 152 and a pair of side surfaces 153 together defining a plug receiving opening 130 at a forward end thereof for receiving the forward receiving slots of the insulative housing. A resilient latching rib 141 upwardly and forwardly extends from a rear edge of the top surface 151 of the shell 13, forming an acute angle relative to the top surface 151. A distal end of the latching rib 141 bends downwardly and forwardly to form a front end 142 of the latching rib 141. A top flange 131 upwardly extends from a forward edge of the top surface 151 of the shell 13 and is substantially perpendicular to the top surface 151 and the distal end of the latching rib 141. A top edge of the top flange 131 and a top projection of the latching rib 141 are at substantially identical heights. A side flange 133 outwardly depends from a forward edge of each side surface 153, and a locking tab 138 is generally rearwardly formed on an upper portion of an outward edge of each side flange 133. A bottom flange 132 downwardly depends from a forward edge of the bottom surface 152. A retaining flange 134 is stamped and formed from the bottom surface 152 of the shell 13, being adjacent to and parallel to the bottom flange 132 (shown in FIGS. 3A–3E).

Also referring to FIGS. 1 and 2, the conductive panel 20 is rectangular and defines a generally rectangular mating slot 21 coinciding with the plug receiving opening 130. A top projection 231 extends inwardly from a top edge of the mating slot 21 and is substantially perpendicular to the conductive panel 20 for being received in a space between the top flange 131 and the front end 142 of the latching rib 141 of the shell 13. A bottom projection 232 extends inwardly from a bottom edge of the mating slot 21 and is substantially perpendicular to the conductive panel 20 for being received in a space formed between the bottom flange 132 and the retaining flange 134 of the shell 13. First and second retaining tongues 271, 272 respectively inwardly extend from opposite side edges of the mating slot 21 of the conductive panel 20 for firmly contacting the side surfaces 153 of the shell 13 for orienting the shell 13 of the electrical connector. The first retaining tongue 271 and the second retaining tongue 272 are located at different heights. A pair of notches 25 is respectively defined in opposite inside edges of the mating slot 21 for latching the pair of locking tabs 138 of the side flanges 133 of the shell 13.

Figure 4:
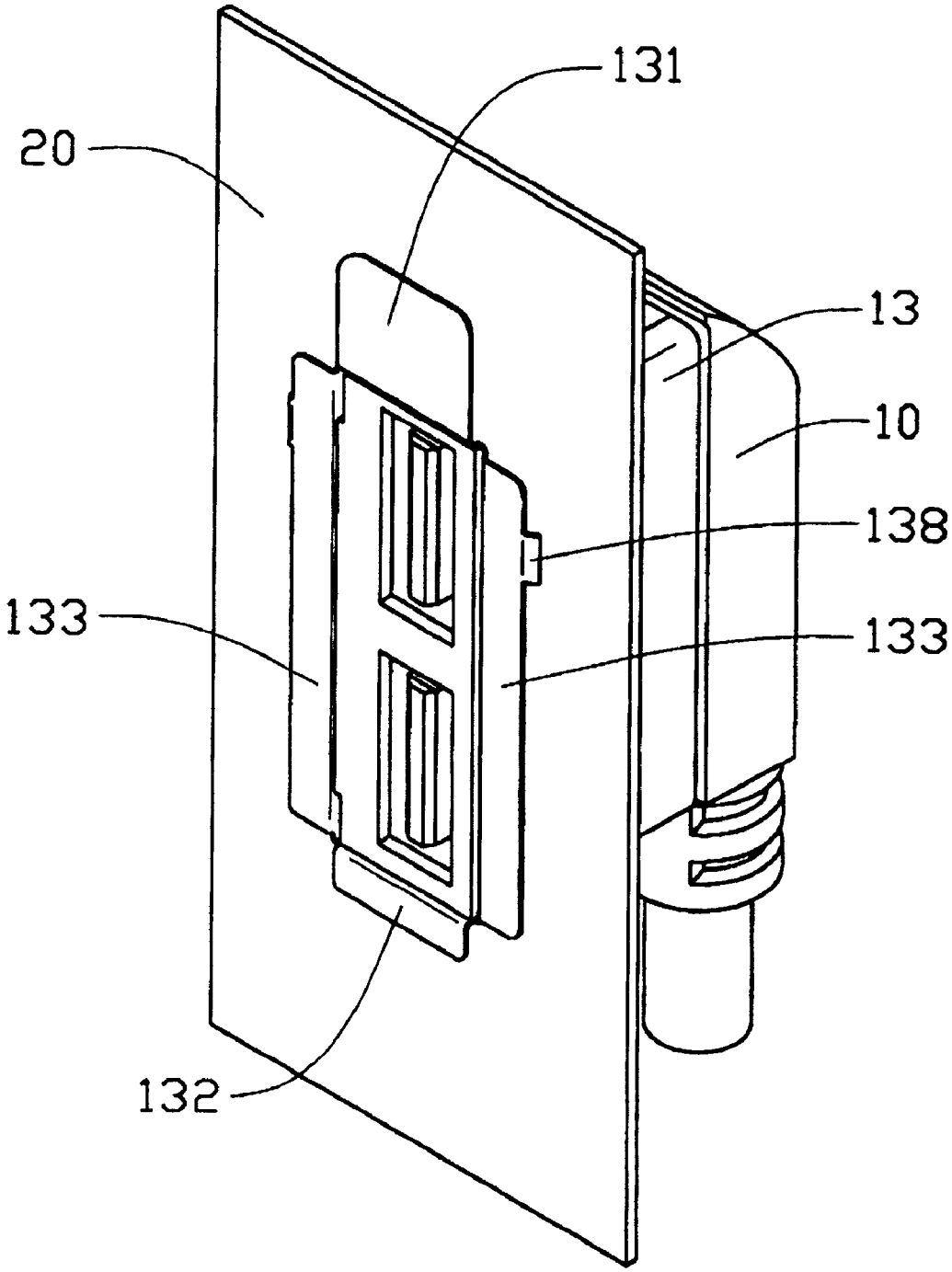
FIG. 4 is an assembled view of FIG. 1.
Figure 5:
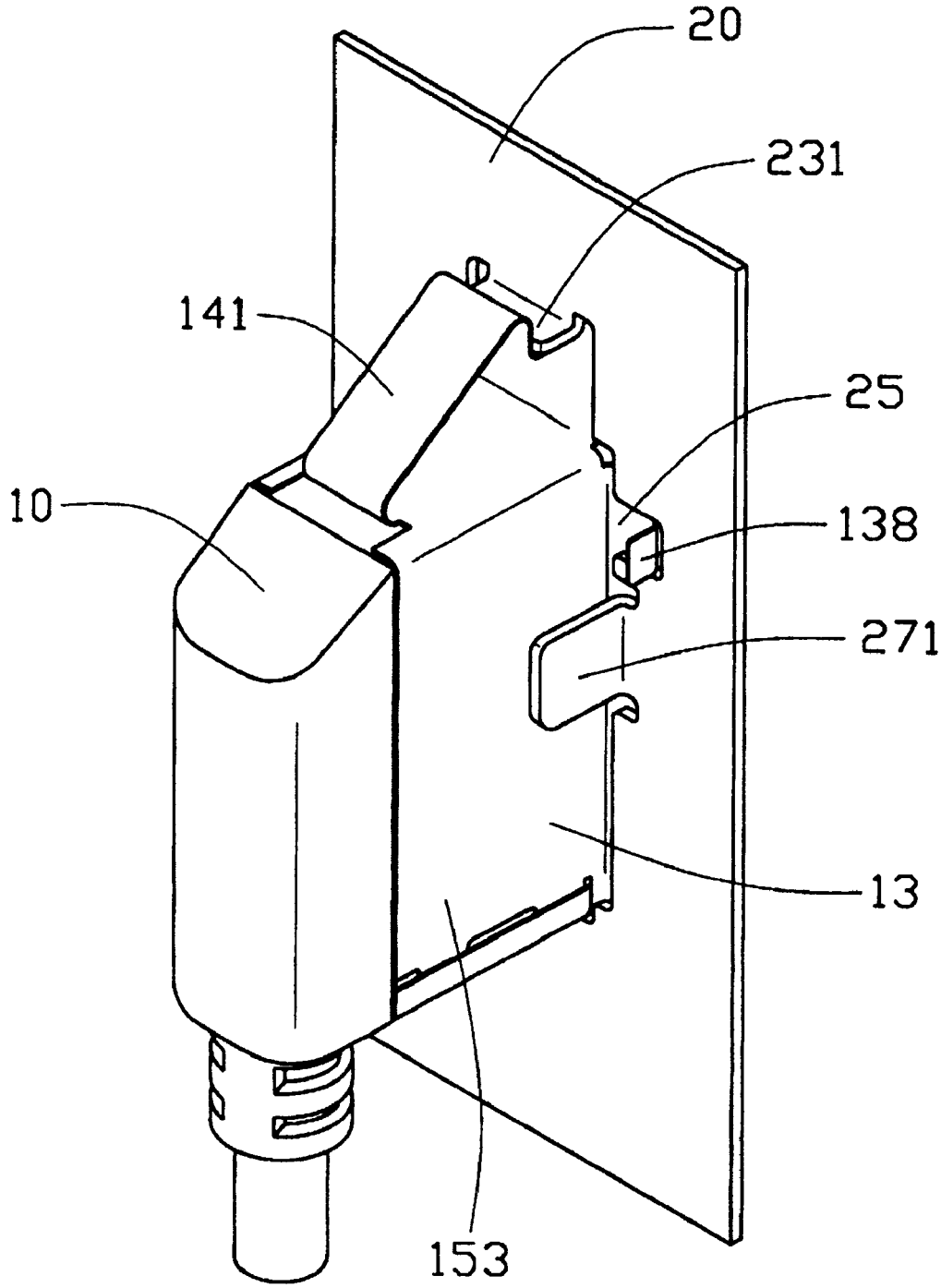
FIG. 5 is an assembled view of FIG. 2.
Figure 6:
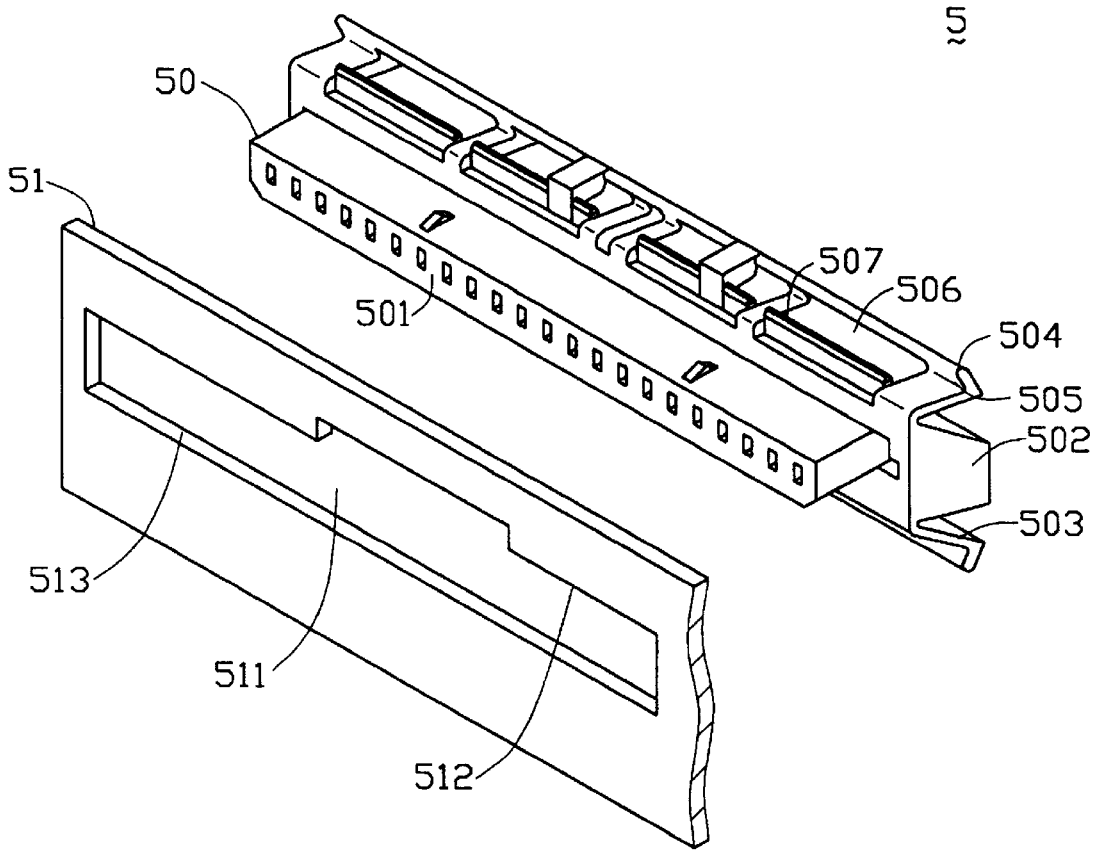
FIG. 6 (PRIOR ART)
FIG. 6 is an perspective view of an unassembled conventional electrical connector system.

In assembly, referring to FIGS. 3A to 3D, the cable (not labeled) depending from the connector 10, plus a termination connector (not shown) on an opposite end of the cable are first inserted through the mounting slot 21 of the conductive panel 20. Then the lower part of the shell 13 of the electrical connector 10 is inserted inward through the mating slot 21 of the conductive panel 20. The bottom flange 132 and the retaining flange 134 of the shell 13 contact the bottom projection 232 of the conductive panel 20. The top projection 231 of the conductive panel 20 abuts against the inclined face of the latching rib 141 of the shell 13. The electrical connector 10 is then rotated to an upright position as shown in FIGS. 4 and 5 where the top projection 231 of the conductive panel 20 is retained between the top flange 131 and the front end 142 of the latching rib 141 of the shell 13 due to the resiliency of the latching rib 141. The bottom projection 232 of the conductive panel 20 is retained between the bottom flange 132 and the retaining flange 134 of the shell 13. The top flange 131, the bottom flange 132 and the pair of side flanges 133 abut against an outside face 29 of the conductive panel 20. Moreover, the pair of locking tabs 138 of the shell 13 respectively latches with the notches 25 of the conductive panel 20. The first and the second retaining tongues 271, 272 contact the side surfaces 153 of the shell 13, the first retaining tongue 271 being substantially higher than the second retaining tongue 272 for firmly contacting the side surfaces 153 of the shell 13.

Figure 3A:
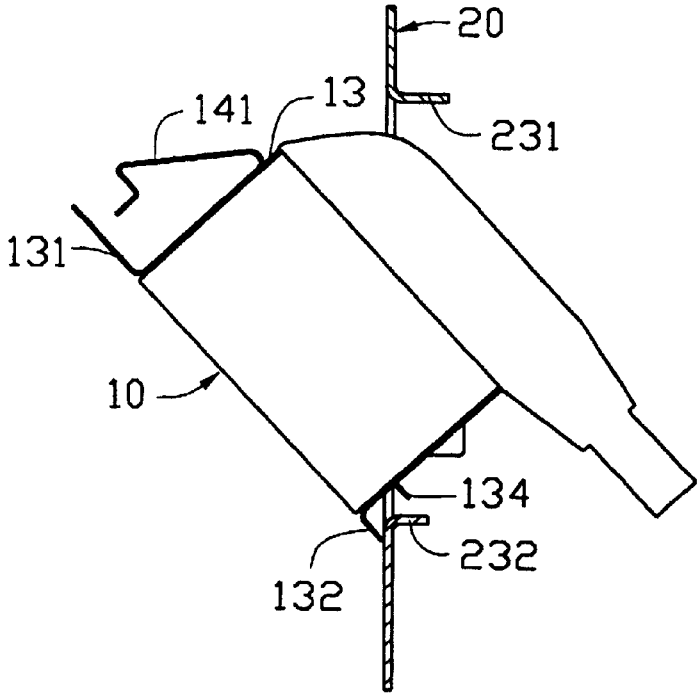
FIGS. 3A–3D are sequential side views of the electrical connector system of FIG. 1 being connected together.
Figure 3B:
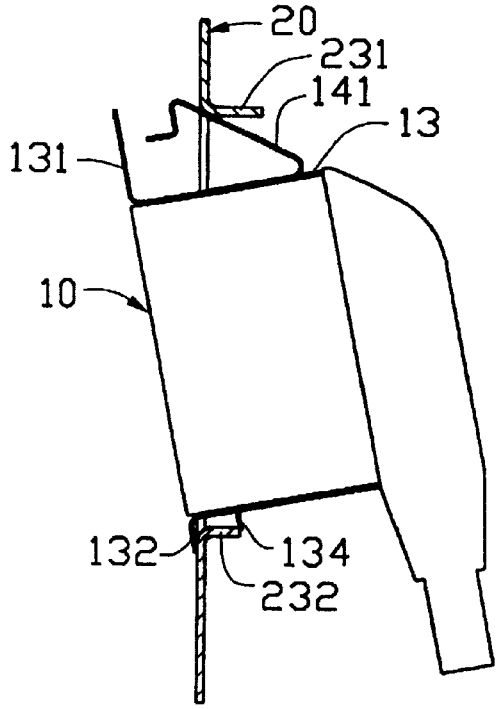
Figure 3C:
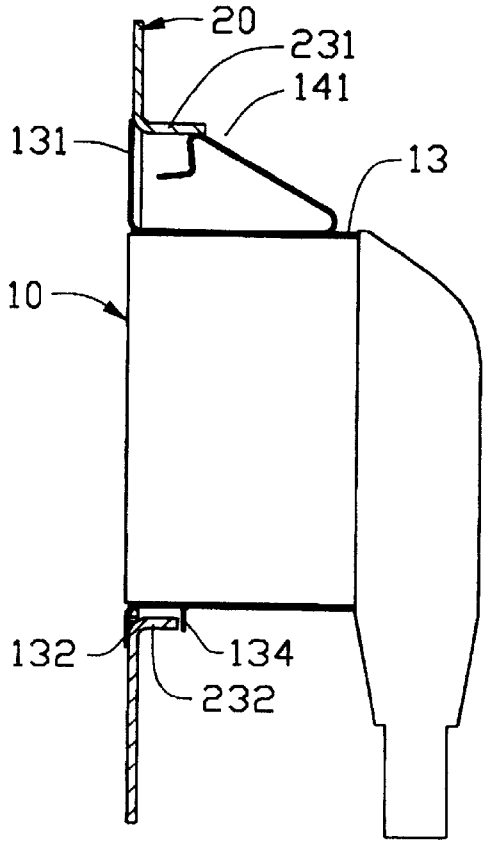
Figure 3D:
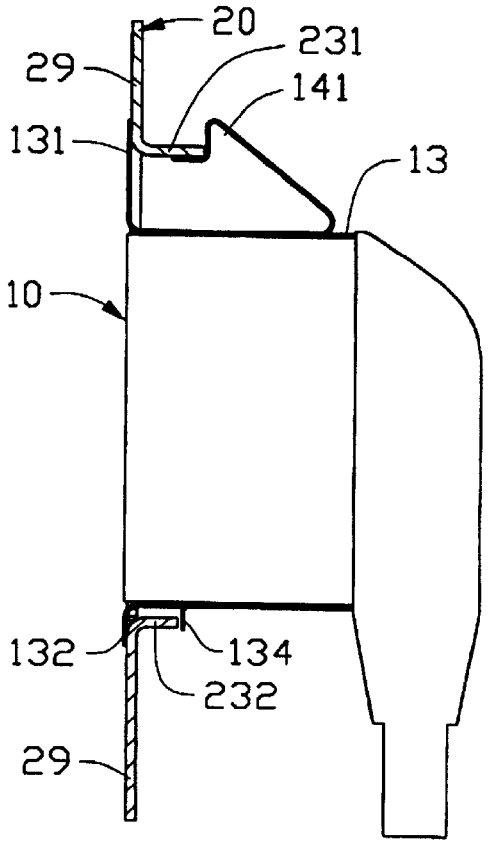

During disassembly, referring to FIG. 3D, a force is exerted against the latching rib 141 of the shell 13 in a direction substantially vertical to the inclined face of the latching rib 141, and the top projection 231 of the conductive panel 20 is then removed from the space between the latching rib 141 and the top flange 131 of the shell 13 by tilting a top of the electrical connector 10 out of the mating slot 21. Thus the upper portion of the electrical connector is disassembled from the mating slot 21. The electrical connector 10 is then pushed upward and outward out of the mating slot 21 thereby disengaging the bottom projection 232 of the panel 20 from the space between the bottom flange 132 and the retaining flange 134 of the shell 13. The cable (not labeled) depending from the electrical connector 10, plus the termination connector (not shown) on an opposite end of the cable, can now be withdrawn through the mating slot 21 of the conductive panel 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector system comprising:

a conductive panel defining a mating slot, a top projection and a bottom projection respectively depending inward from a top edge and a bottom edge of the mating slot in substantially a perpendicular relationship with respect to the conductive panel; and an electrical connector mounted on the conductive panel and including an insulative housing and a shell enclosing the insulative housing, the shell having a top surface, a bottom surface and a pair of side surfaces, a top flange, a bottom flange and a pair of side flanges respectively depending from individual forward edges of the top surface, the bottom surface and the pair of side surfaces for abutting against an outward face of the conductive panel, a resilient latching rib extending from a rearward edge of the top surface, the top flange and the latching rib cooperating with each other to retain the top projection of the conductive panel, a retaining flange downwardly depending from the bottom surface, the bottom flange and the retaining flange cooperating with each other to retain the bottom projection of the conductive panel.

2. The electrical connector system as claimed in claim 1, wherein a distal end of the latching rib of the shell bends downwardly and forwardly.

3. The electrical connector system as claimed in claim 2, wherein the top flange of the shell is substantially perpendicular to the top surface and the distal end of the latching rib.

4. The electrical connector system as claimed in claim 1, wherein a locking tab is generally rearwardly formed on an outer edge of each side flange, and a pair of notches are defined in opposite inside edges of the mating slot for latching with the pair of locking tabs of the side flanges of the shell.

5. The electrical connector system as claimed in claim 1, wherein first and second retaining tongues respectively extend inward from opposite side edges of the mating slot of the conductive panel and contact the side surfaces of the shell for orienting the shell of the electrical connector.

6. The electrical connector system as claimed in claim 5, wherein the first retaining tongue and the second retaining tongue are located at different levels of height.

7. An electrical connector for mounting on a conductive panel, comprising:

an insulative housing; and a shell enclosing the insulative housing and including a top surface, a bottom surface and a pair of side surfaces, a top flange, a bottom flange and a pair of side flanges respectively depending from individual forward edges of the top surface, the bottom surface and the pair of side surfaces for abutting against an outside face of a conductive panel, a resilient latching rib extending from a rearward edge of the top surface, the top flange and the latching rib cooperating with each other to retain a top projection of the conductive panel, a retaining flange downwardly depending from the bottom surface, the bottom flange and the retaining flange cooperating with each other to retain a bottom projection of the conductive panel.

8. The electrical connector as claimed in claim 7, wherein a distal end of the latching rib of the shell bends downwardly and forwardly.

9. The electrical connector as claimed in claim 7, further comprising a locking tab generally rearwardly formed on an outer edge of each side flange for latching with the conductive panel.

10. An electrical connector assembly comprising:

a conductive panel defining a mating slot with at least a projection perpendicularly extending inward from a first edge thereof;

an electrical connector, with a cable extending from a rear portion thereof, mounted to the panel and including an insulative housing enclosed by a shell, said shell defining a first face and an opposite second face, a first flange and a second flange extending from the first face and aligned with each other in a front-to-back direction and with a space therebetween, a resilient latching rib extending forward from a rear portion of the second face of the shell, said latching rib defining a front end which abuts against an abutment portion of the panel around a second edge of the mating slot which is opposite to said first edge; wherein the connector and the associated cable are assembled to the panel in said front-to-back direction with the first flange abutting against the panel around the first edge, the projection of the panel being sandwiched between the first and second flanges, and the latching rib abutting against the abutment portion for preventing movement of the connector in a back-to-front direction when the connector is fully assembled to the panel.

11. The connector assembly as claimed in claim 10, wherein said shell further includes a third flange extending on the second face in front of and in alignment with said latching rib in the front-to-back direction so as to cooperate with the latching rib to sandwich the abutment portion of the panel therebetween.

12. The connector assembly as claimed in claim 11, wherein said abutment portion of said panel is another projection perpendicularly extending inwardly from the second edge of said mating slot.

13. A method of assembling a cable connector device to a panel, comprising the steps of:

providing a connector with a cable connected on a rear portion thereof, said connector including an insulative housing enclosed by a shell;

providing said shell with a pair of flanges on a first face and a resilient latching rib on a second face opposite to said first face;

providing a panel with a mating slot;

providing said panel with a projection positioned on a first edge of said mating slot;

inserting the cable connector device through said mating slot in a front-to-back direction with the projection retained between said pair of flanges; and rotating the connector about the projection until the resilient latching rib first is deflected inwardly to pass a second edge of saidmating slot opposite to said first edge thereof and successively sprung outwardly to abut against an abutment portion around the second edge of the mating slot of the panel.

* * * * *